US009605461B2

(12) United States Patent
Zimmer et al.

(10) Patent No.: US 9,605,461 B2
(45) Date of Patent: Mar. 28, 2017

(54) DOOR FITTING FOR THE HEIGHT ADJUSTMENT OF SLIDING DOORS

(71) Applicants: Guenther Zimmer, Rheinau (DE); Martin Zimmer, Rheinau (DE)

(72) Inventors: Guenther Zimmer, Rheinau (DE); Martin Zimmer, Rheinau (DE)

( * ) Notice: Subject to any disclaimer, the term of this patent is extended or adjusted under 35 U.S.C. 154(b) by 0 days.

(21) Appl. No.: 15/072,283

(22) Filed: Mar. 16, 2016

(65) Prior Publication Data

US 2016/0273253 A1 Sep. 22, 2016

(30) Foreign Application Priority Data

Mar. 17, 2015 (DE) ..... 10 2015 003 413

(51) Int. Cl.

| | |
|---|---|
| ***E05D 15/06*** | (2006.01) |
| ***E05F 5/00*** | (2017.01) |
| ***E05F 1/16*** | (2006.01) |
| ***E06B 3/46*** | (2006.01) |
| *E05D 15/56* | (2006.01) |

(52) U.S. Cl.

CPC ..... *E05D 15/0669* (2013.01); *E05F 1/16* (2013.01); *E05F 5/003* (2013.01); *E06B 3/4636* (2013.01); *E05D 15/565* (2013.01); *E05Y 2201/638* (2013.01); *E05Y 2800/00* (2013.01); *E05Y 2800/24* (2013.01); *E05Y 2900/132* (2013.01)

(58) Field of Classification Search

CPC ..... E05D 15/0669; E06B 3/4636; E05F 1/16; E05F 5/002

USPC ..... 49/425

See application file for complete search history.

(56) References Cited

U.S. PATENT DOCUMENTS

| | | | | | |
|---|---|---|---|---|---|
| 4,262,451 | A * | 4/1981 | Dallaire | E05D 15/0669 | 16/105 |
| 4,404,771 | A * | 9/1983 | Murase | E05D 15/0669 | 16/105 |
| 4,899,493 | A * | 2/1990 | Baumgarten | E05D 15/0665 | 16/91 |
| 5,791,089 | A * | 8/1998 | Prevot | E05D 15/0669 | 49/425 |
| 5,845,363 | A * | 12/1998 | Brempell | E05D 15/0669 | 16/105 |
| 5,860,189 | A * | 1/1999 | An | E05D 15/0669 | 16/105 |

(Continued)

FOREIGN PATENT DOCUMENTS

| | | | | |
|---|---|---|---|---|
| CA | 2835580 A1 * | 6/2014 | ..... | E05D 15/0669 |
| CN | 1026 19435 A | 8/2012 | | |
| DE | 693 06 287 T2 | 12/1996 | | |

*Primary Examiner* — Jerry Redman
(74) *Attorney, Agent, or Firm* — Klaus J. Bach

(57) ABSTRACT

In a door fitting with height adjustment for a sliding door panel with a housing in which a support roller is rotatably supported, a sliding door panel lifting member is slidingly supported by guide elements extending from the support base member into inclined guide passages formed in the housing side wails whereby the sliding door panel can be raised or lowered by longitudinal movement of the lifting member relative to the housing, the inclined guide passages are provided with end walls which limit the movement of the guide elements in the inclined passages to limit the height adjustment and an access area is formed at an upper end of each guide passage. Adjustment elements are provided for the movement of the base member relative to the housing.

9 Claims, 6 Drawing Sheets

(56) References Cited

U.S. PATENT DOCUMENTS

| | | | | |
|---|---|---|---|---|
| 5,927,017 | A * | 7/1999 | Jacobs | E05D 15/0673 16/96 R |
| 5,950,279 | A * | 9/1999 | Chaput | A47H 1/08 16/105 |
| 6,021,547 | A * | 2/2000 | Stagoll | E05D 15/0669 16/105 |
| 6,813,862 | B2 * | 11/2004 | Perich | E05B 65/0876 16/105 |
| 8,240,089 | B2 * | 8/2012 | Lambertini | E05D 15/565 49/226 |
| 2005/0011041 | A1 * | 1/2005 | Ness | E05D 15/0669 16/105 |
| 2007/0017065 | A1 * | 1/2007 | Hutnik | E05D 15/0669 16/91 |
| 2014/0310913 | A1 * | 10/2014 | Horwood | E05D 15/0669 16/100 |

* cited by examiner

DOOR FITTING FOR THE HEIGHT ADJUSTMENT OF SLIDING DOORS

BACKGROUND OF THE INVENTION

The invention resides in a door fitting for the height adjustment of a sliding door between a basic rest position and an upper end position, including a housing in which at least one guide roller is rotatably supported and a lift member which is adjustably supported in the housing by at least two inclined pathways and at least four guide elements, wherein each inclined pathway has two stops of which a first stop delimits the rest position and the second stop limits the upper end position. The invention also resides in a sliding door with at least one such door fitting.

Elements of such a door fitting are known from DE 693 06 287 T2. Herein, however, during height adjustment, the lift member may tip over, or it may leave the inclined pathway.

CN 102 619 425 A proposes to provide in the lift member longitudinal grooves which are inclined and into which guide pins extend which are arranged in the housing. However, the installation of the guide pins requires a special additional installation procedure.

It is the object of the present invention to provide a height adjustable door fitting which is easy to install and safe in its operation.

SUMMARY OF THE INVENTION

In a door fitting with height adjustment for a sliding door panel with a housing in which a support roller is rotatably supported, a sliding door panel lifting member is slidingly supported by guide elements extending from the support base member into inclined guide passages formed in the housing side walls whereby the sliding door panel can be raised or lowered by longitudinal movement of the lifting member relative to the housing, the inclined guide passages are provided with end walls which limit the movement of the guide elements in the inclined passages to limit the height adjustment and an access area is formed at an upper end of each guide passage. Adjustment elements are provided for the movement of the base member relative to the housing.

The invention will become more readily apparent from the following description of an exemplary embodiment with reference to the accompanying drawings.

BRIEF DESCRIPTION OF THE DRAWINGS

It is shown in.

DESCRIPTION OF AN EXEMPLARY EMBODIMENT

Figure 1:
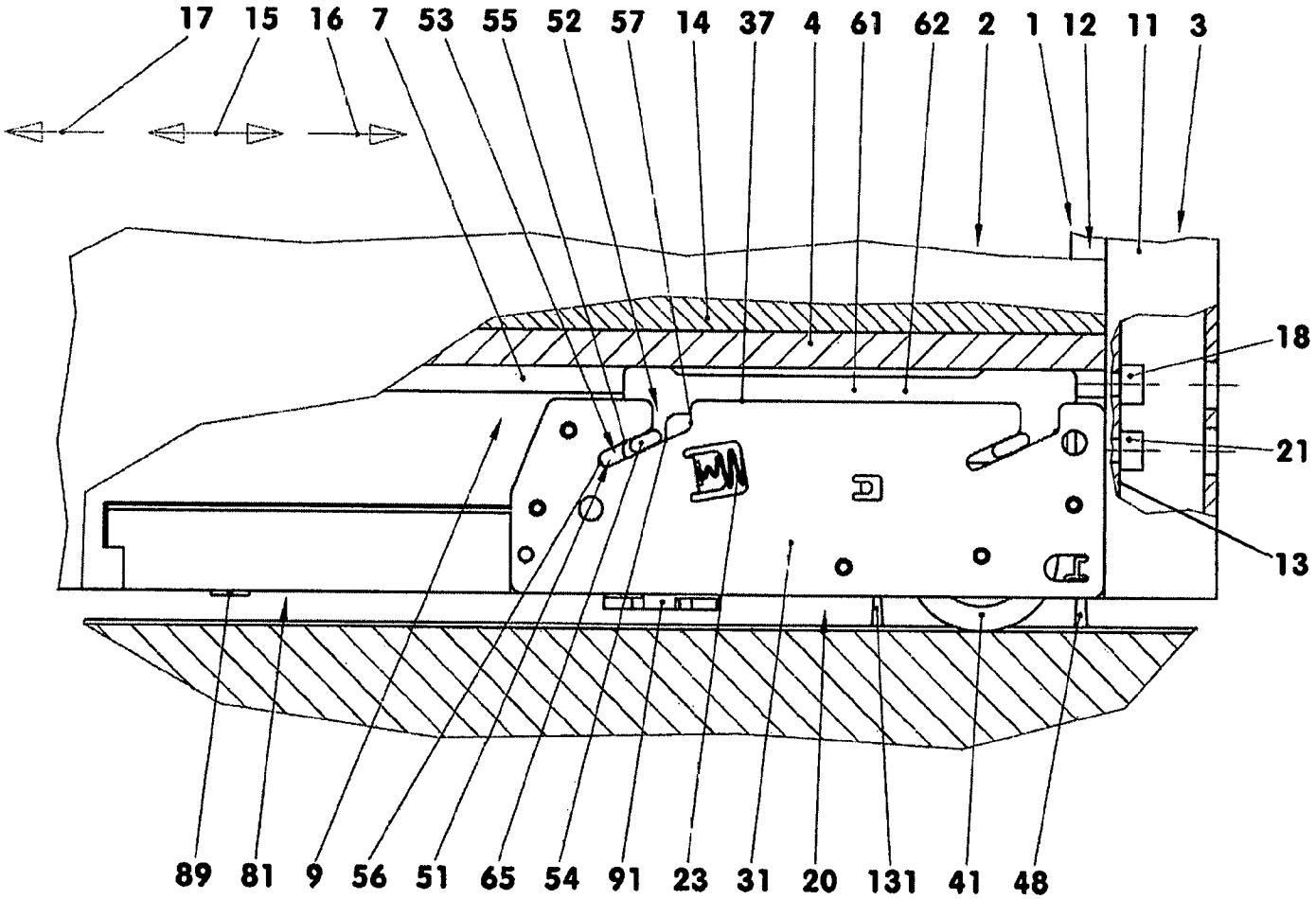
FIG. 1: a sliding door with a door fitting.
Figure 2:
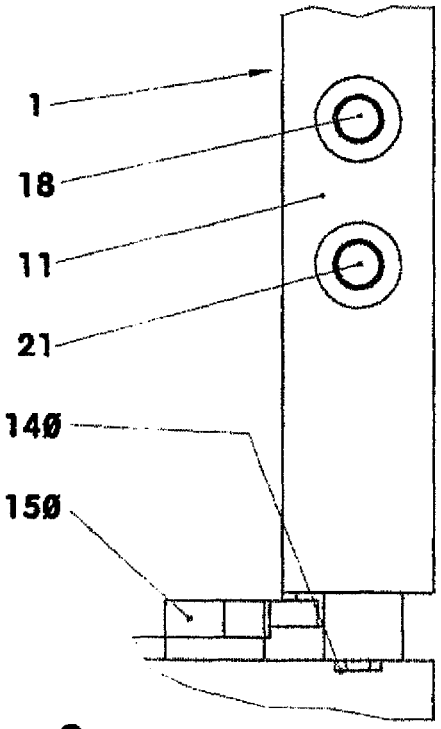
FIG. 2: a front view of the sliding door.

FIGS. 1 and 2 show a sliding door 1. Such, sliding doors are used for example for closing closets, for separating rooms, etc. The sliding doors 1 are movable back and forth from an open position, in which they permit access to the closet or to the room, to a closed position in which the access is blocked. The movement of the sliding door 1 for example relative to a door frame may be achieved by hand or by a motor.

In the exemplary embodiment the sliding door 1 comprises a support frame a door panel 14 and at least one door fitting 20.

The support frame 3 of the sliding door 1 consists for example of four profile elements 4, 10, which extend around a door panel 14 in the form of a quadrilateral. The individual profile elements 4, 11, of which only a lower horizontal element 4 and a front end vertical profile element are shown in FIGS. 1 and 2, are for example formed from aluminum in a continuous casting process. All profile elements 4, 11 have a U-shaped profile opening 5, 12 oriented toward the door panel 14.

Figure 3:
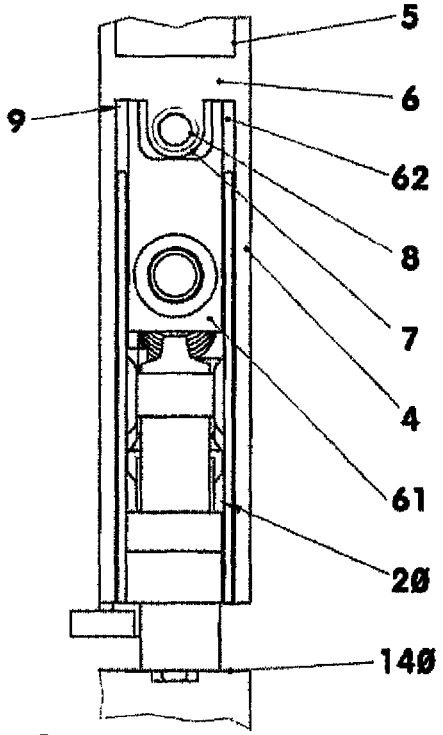
FIG. 3: a view as shown in FIG. 2 with the vertical front element removed.
Figure 4:
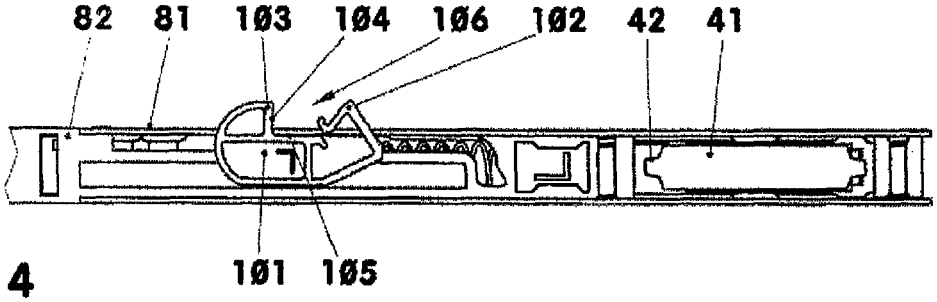
FIG. 4: a bottom view of the door fitting with a carrier element.
Figure 5:
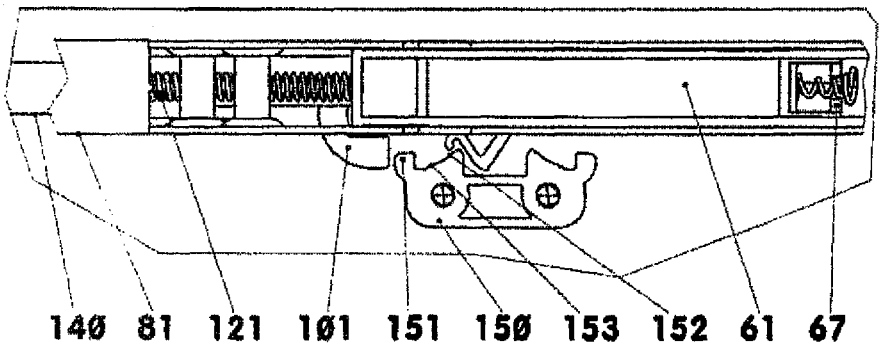
FIG. 5: a top view of the door fitting.
Figure 6:
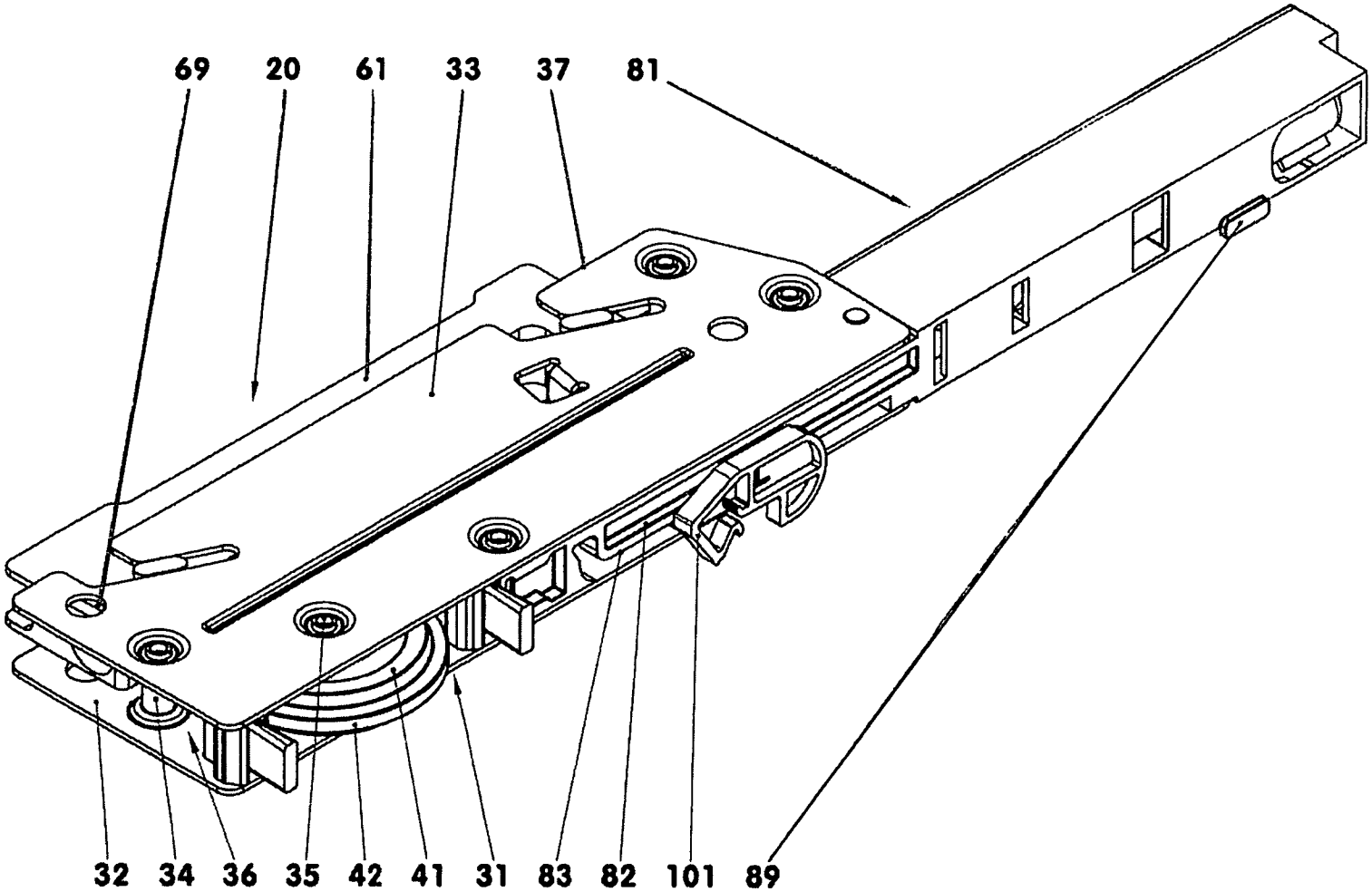
FIG. 6: an isometric view of the door fitting.
Figure 7:
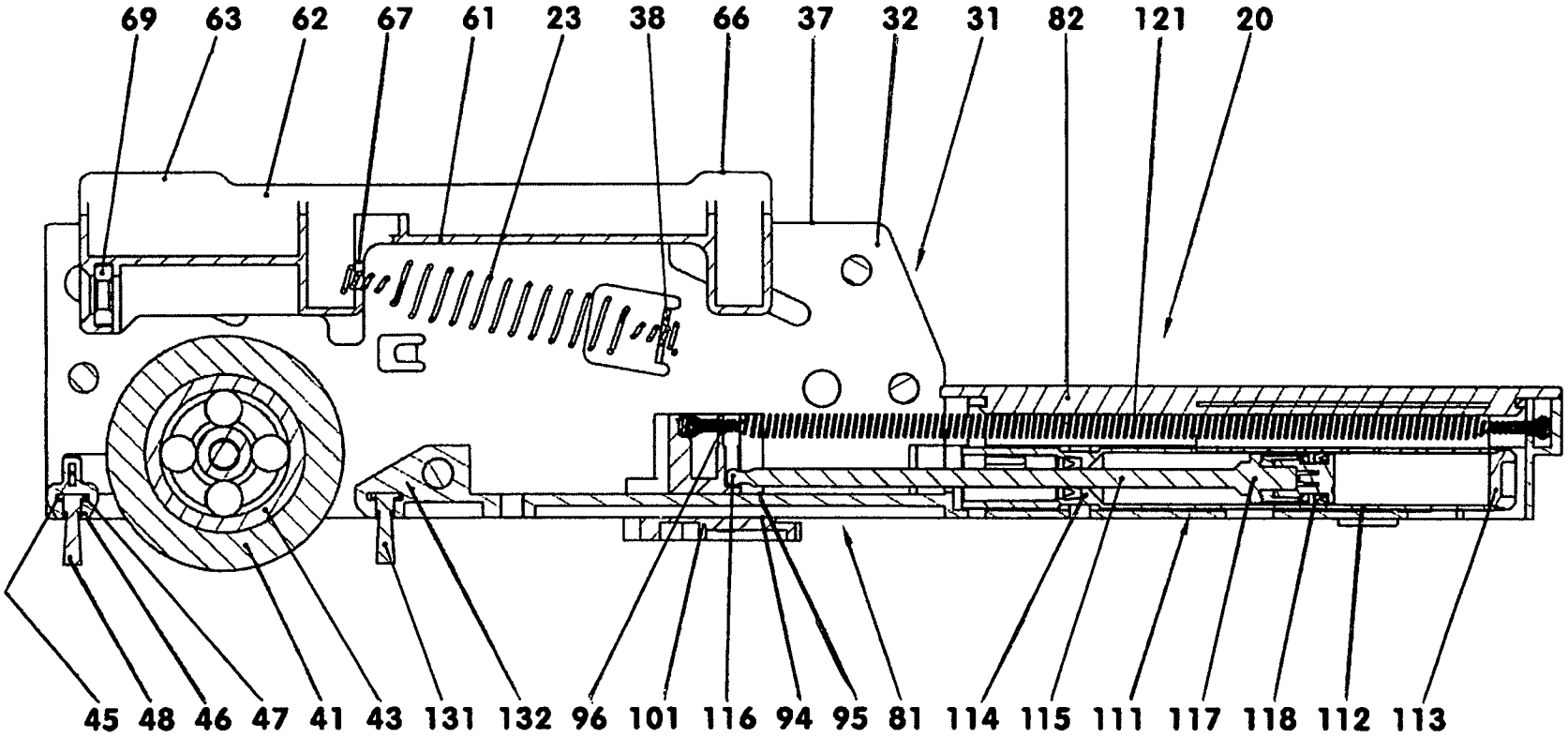
FIG. 7: a longitudinal cross-sectional view of the door-fitting.
Figure 8:
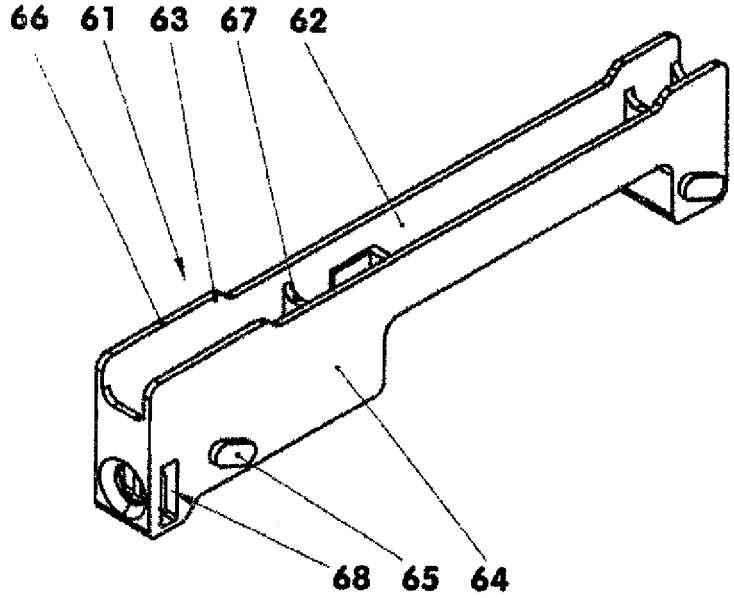
FIG. 8: a lift element.
Figure 9:
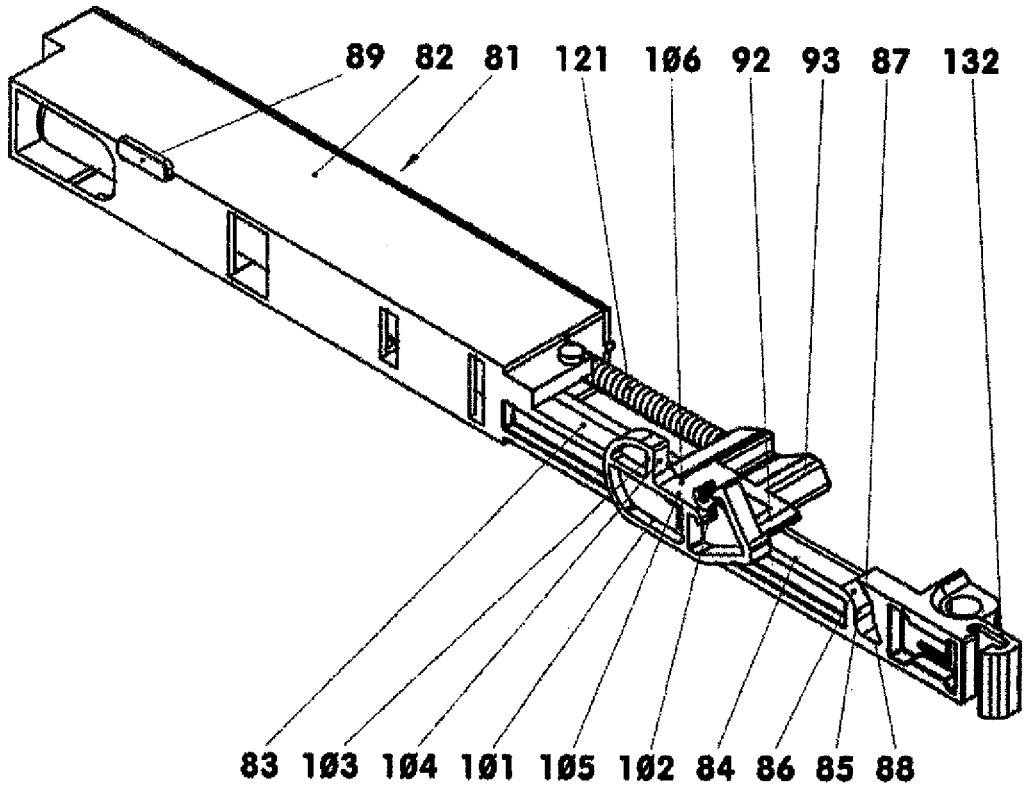
FIG. 9: an acceleration and deceleration arrangement.

At the side facing away from the profile opening 5, the horizontal profile element 4 is at least essentially U-shaped, see FIG. 3, For example, in the parallelepiped accommodation opening 9 a cylindrical rod 7 with a longitudinally oriented internal thread 8 is arranged adjacent the profile web 6.

The vertical profile element 11 has at the side facing away from the profile opening 12 an approximately rectangular cross-section. In this profile element 11, an upper mounting screw 18 and a lower adjustment screw 21 are arranged. By way of the mounting screw 18, the vertical profile element 11 is connected to the horizontal profile element 4. The mounting screw 13 is threaded into the internal thread 8 of the cylindrical rod 7.

The door panel 14 is for example a rectangular plate with a width less than the width of the support frame 3. It may consist of metal, wood, plastic, glass or another material. It may also be in the form of a laminate or it may be in the form of a glass panel insert in a wooden frame. The door panel may be solid or it may be a lightweight design in the form of spaced cover panels joined by a honeycomb core.

The door fitting 20 is inserted into the accommodation opening 9 of the horizontal profile element 4. In the exemplary embodiment, it extends into the profile opening 12 of the vertical profile element 11. The door fitting 20 comprises a housing 31, a lift member 61 and an acceleration and deceleration arrangement 81. FIGS. 4-9 show the door fitting and its components. The door fitting 20 as shown in the figures is a left side door fitting. Except for the mirror-reversed set-up of the acceleration and deceleration arrangement 81, it is identical to a right side door fixture 20.

The housing 31 has two side plates 32, 33, which are interconnected in the exemplary embodiment by means of spacer pins 34, 35. In the lower area of the housing, a support-roller 41 is rotatably supported. The support roller 41 has for example a guide ring 42 and an integrated anti-friction bearing whose inner ring 43 is disposed on the lower spacer pin 35 which forms a support shaft. At the bottom side of the housing 31, two cleaning brushes 48, 131 are arranged of which, in FIGS. 1, 3 and 4, one is arranged ahead of, and the other behind, the support roller 4.

Each of the side plates 32, 33 of the housing 31 has an essentially rectangular contour. The right side plate 32 includes in the exemplary embodiment a brush receiving holder 45 and a spring holder 38.

The strip-shaped brush holder 45 is arranged in the lower area of the side plate 33. It carries a brush carrier 46 with a T-groove 47 in which the front cleaning brush 43 is inserted.

The spring holder 38 is U-shaped and opens toward the interior 36 of the housing 31. In the spring holder 38, one end of a tension spring 23 is engaged so as to form a return element 23. The other end of the tension spring 23 is connected to the lift member 61.

Adjacent their top ends 37, the side plates 32, 33 of the housing 31 are provided with spaced grooves 51, which are open at one side. The two grooves 51 of one side plate 32, 33 are identical in shape and extend parallel to each other. Both grooves 51 have an upper insertion area 52 and a guide area 53. The guide area 53 is provided in each case with a lower inclined path 54 and an upper security path 55. At their lower ends, these paths 54, 55 are joined by a stop 56. A further stop 57 is arranged at the upper end of the inclined path 54. The further stop 57 is part of the insertion area 52.

In the grooves 51, the lift member 61 is guided. The lift member 61 which has a cross-sectional shape essentially in the form of an H comprises a spring holder 67, four guide elements 65 and longitudinal webs 62 extending in the longitudinal direction 15. At its front end, the lift member 61, which consists for example of plastic is provided with a transverse accommodation groove 68 in which in the exemplary embodiment a threaded insert 69 is disposed. The adjustment screw 21 is threaded into this threaded insert 69. The adjustment screw 21 find the threaded insert 69 form an adjustment arrangement 21, 69 of the door fitting 20.

The guide elements 65 are arranged on the opposite outer sides 64 of the lift member 61. They have all an oval cross-sectional area. In each groove 51 of the housing 31, there is one guide element 65. The longer axis of the cross-sectional area of the guide elements 65 is oriented in the longitudinal direction of the respective groove 51.

The longitudinal webs 62 are arranged at the top side 66 of the lift member 61. They are in alignment with the outer sides 64 of the lift member 61 and extend at a constant distance from each other. In the rear and in the front area, the longitudinal webs 62 have raised areas 63. In those areas, the longitudinal webs 62 serve as abutment webs 63. The top sides of the abutment webs 62 extend in a common plane.

The acceleration and deceleration arrangement 81 is mounted in the housing 31. It may for example be locked in place. It comprises a support part 82 in which a cylinder-piston unit 111, an energy store 121 and a carrier element 91 are arranged.

The support part 82 includes in the exemplary embodiment a guide surface 83 which comprises a straight guide section 84 oriented parallel to the longitudinal direction 15 of the door fitting 20 and a holding section 85 which extends for example normal to the guide section 84. The two sections 84/85 are joined by a curved section 86. The holding- and the curved sections are part of a guide groove 87 with a widened end area 88.

The carrier element 91 is movable along the guide surface 83. The carrier element 91 extends over the support part 82. It has for example two slide elements 92, a guide and accommodation element 91 and a drag range 101.

The rod-like slide elements 92 are spaced from each other and are disposed on the guide surface 83. The slide elements 92 interconnect the drag range 101 and the guide and accommodation element 93.

The drag range 101 comprises two stop pins 102, 103 with stop surfaces 104 which extend parallel and face each other. They extend for example normal to a tangential plane of the slide elements 92. The two stop surfaces 104 delimit, together with a bottom surface 105, a carrier cavity 106. The drag range 101 has a first guide surface 94 facing the support part 82. The stop pin 102 facing the holding section 85 is in accordance with the exemplary embodiment elastically deferrable.

The guide and accommodation element 93 comprises a second guide surface 95 which extends parallel to the first guide surface 94 and a spring holder 96. The spring holder 96 points in a direction away from holding section 85.

In the spring holder 96, one end of a tension spring 121 is engaged. The other end of the tension spring 12 is supported in the support part 82. In the exemplary embodiment, the tension spring 121 forms the energy store for the acceleration and deceleration arrangement 81.

The cylinder-piston unit 111 comprises a cylinder 112 and a piston 117 guided in the cylinder 112 by means of a piston rod 115. The piston rod 115 is provided at its front end remote from the piston 117 a piston rod head 116, which is pivotally supported by the carrier element 91.

The cylinder 112 has a closed end 113. Its internal wall may be cylindrical or conical. The inner wall of the cylinder 112 has for example two longitudinally extending grooves of different length, which both end at the cylinder end 113. The length of the shorter groove is for example one fourth of the length of the cylinder. The length of the longer groove is for example, three fourths of the length of the cylinder 112. At the piston rod end, the cylinder 112 is closed by means of a cylinder head cover including a piston rod seal.

The piston 117 is provided in the exemplary embodiment with a piston seal 118, which has a seal lip directed toward the closed cylinder end 113. The piston 117 may be formed integrally with the piston rod 115 and/or the piston seal 118.

Further, the acceleration and deceleration arrangement 81 is provided with a brush carrier 132 including the cleaning brush 131.

A carrier member 150 which is arranged on a door track 140 is shown in the exemplary embodiment as a, with respect to its transverse axis, symmetrical component with four engagement projections 151, 152. The engagement projections 151, 152 are separated by a groove 153. Together they have a length which is slightly shorter than the distance between the stop surfaces 104 of the carrier element 91.

During assembly, for example, first the acceleration and deceleration arrangement 81 is installed. Herein, the piston rod 115 with the piston 117 is inserted into the cylinder 112 and the cylinder is closed by the cylinder head cover 114. Subsequently, the cylinder-piston unit 111 with the carrier element 91 is inserted into the support part 82 and secured in place. The tension spring 121 is then attached to the carrier element 91 and the support part 82. Also, the brush carrier 132 with the cleaning brush 131 is inserted into the support part 82.

The acceleration and deceleration arrangement 81 is installed together with the support roller 41 and the front-cleaning brush 48 in one half of the housing 31. Now the spacer pins 34, 35 and the second half of the housing 31 can be installed and secured.

In one of the next steps for example, the first tension spring 23 may be connected to the housing 31 and to the lift member 61. The lift member 61 is then together with the threaded insert 69 moved into the housing 31 whereby the guide elements 65 engages into the grooves 51. The first tension spring 23 pulls the lift member 61 into the rest position 24. The fitting 20 preassembled in this way is quite compact. Of course, assembly is also possible in a different order.

The fitting 20 can now be inserted into the support frame 3 of the sliding door 1. Hereby, it is for example disposed accurately fitted in the accommodation opening 9 of the horizontal profile element 4. The stop 89 of the support part 82 of the acceleration and deceleration arrangement 81 prevents an excessively far insertion of the door fitting 20. From the front side of the vertical profile element 11, then the adjustment screw 21 is introduced and screwed into the threaded insert 69.

Figure 10:
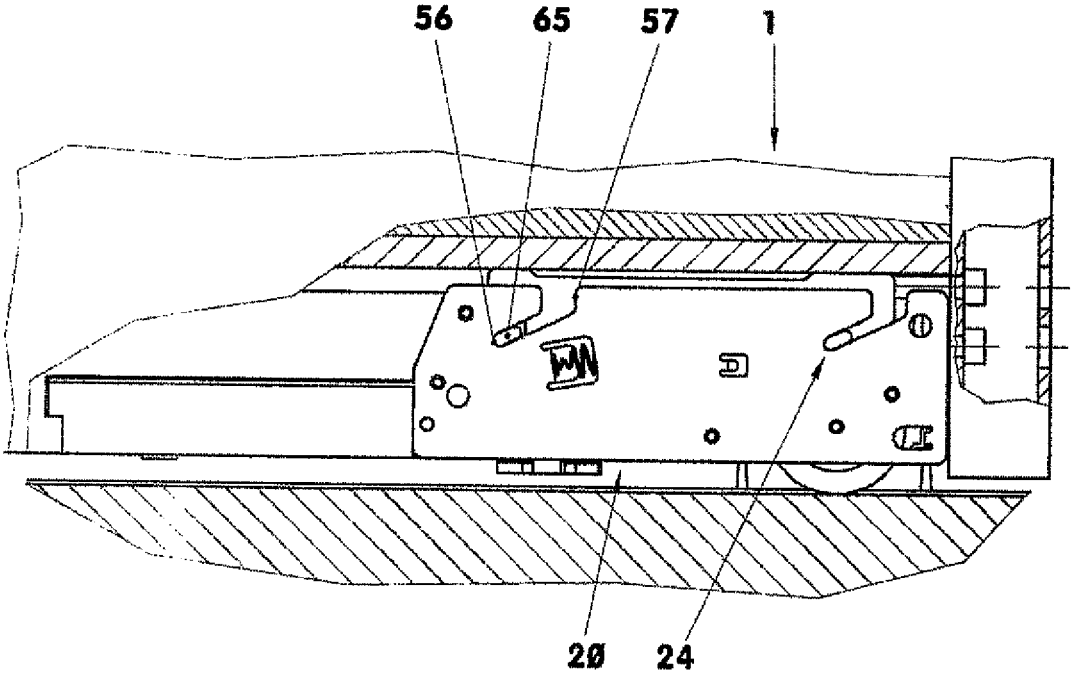
FIG. 10: the door fitting in the rest position.

After placement of the sliding door 1 into the door frame, the support roller 41 is disposed on the door track 140. The two cleaning brushes 48, 131 are in contact with the door track 140 in front of, and behind, the support roller 41. The sliding door 1 is in its lowest position, see FIG. 10. The lift member 61 is in its rest position 24. The piston 117 of the acceleration and deceleration arrangement 81 is fully inserted. The carrier element 91 is in its end position on the straight guide section 84. The energy store 121 is discharged.

The carrier member 150 may be arranged for example at the inside of the closet. This can be achieved for example by using a template or, with the sliding door closed, by adaptation to the carrier element 91 in the inserted position.

Figure 11:
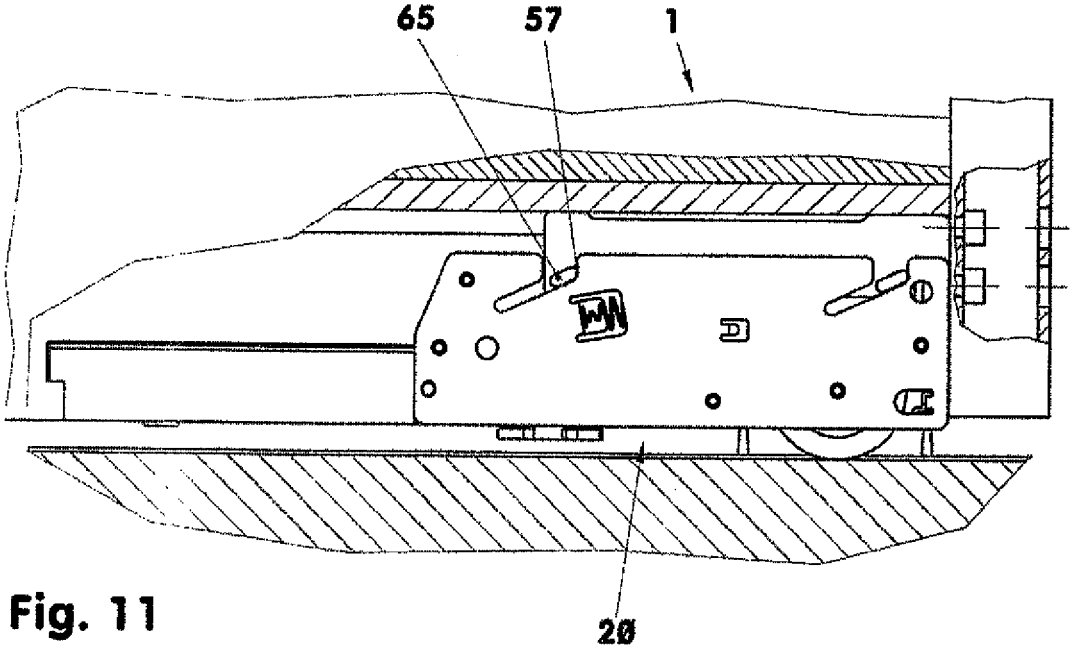
FIG. 11: the door fitting in the end position.

Now the height of the sliding door 1 can be adjusted. For lifting the door, the adjustment screw 21 is screwed into the threaded insert 69. The lift member 61 is thereby moved toward the vertical profile element 11. The lift member moves in the process upwardly along the inclined paths 54. The door panel 14 with the support frame 3 is raised relative to the door trade 140 and the support roller 41. The maximum lift height is limited by the upper stop 57 of the groove 51, see FIG. 11.

For lowering the sliding door 1, the adjustment screw 21 can be screwed in the release direction. The weight of the sliding door 1 and the pull of the tension spring 23 then result in a return movement of the lift member 61 in the inclined paths 54 and a lowering of the sliding door in the housing 31. The sliding door panel 2 can be lowered to the point where the stop 56 of the grooves 51 prevents further lowering, see FIG. 10.

Before the first time closing of the sliding door 1, the acceleration and deceleration arrangement 81 is for example in the end position described above, wherein the energy store 121 is discharged. With the first closing of the sliding door 1, the carrier 150 contacts the front stopping 102 of the carrier element 91 and deforms it. The engagement projections 151, 152 of the carrier member 150 now enter the carrier cavity 106. The stop pin 102 moves back from Its elastically deformed position. The sliding door is now ready for operation.

With a manual or motor-operated opening of the sliding door 1 from its closed position, the carrier member 150 pulls the carrier element 91 out of the end position along the guide surface 83 toward a park position. The energy store is charged in the process. As soon as the—in opening direction—front slide element 92 reaches the guide groove 87, the carrier element 91 pivots down by the effect of the spring 121 and is retained in this park position. While the carrier element 91 remains in the park position, the sliding door can be further opened.

Upon closing the sliding door 1, the carrier element 91 contacts the carrier member 150 before the sliding door reaches the closed end position. The carrier member 150 releases the carrier element 91 from its park position. The carrier member 150 releases the carrier element 91 from its park position. The energy store 121 then pulls the carrier element 91 toward the rest position while being discharged. The sliding door 1 is moved in this way into the closed position. At the same time, the carrier element 91 which is moved relative to the cylinder 112 moves the piston 117 into the cylinder 112. The seal lip of the piston seal 118 is now pressed into contact with the inner cylinder wall and seals in the cylinder inner space a displacement chamber quasi-hermetically, The sliding door 1 slows down as a result. However, as soon as, with further closing of the sliding door 1, the piston reaches the first longitudinal groove in the cylinder inner wall, for example, gas is released from the displacement chamber via the throttling groove into the compensation space. The movement of the sliding door is controlled by a pulling force provided by the energy store 121 and the braking force caused at the same time by the cylinder-piston unit 111. As soon as the piston 117 reaches the short longitudinal groove the retardation rate is further reduced. The sliding door 1 now moves slowly to its closed end position. There, it stops without any shock.

The sliding door 1 may be provided with another fitting 20 which is arranged at the end of the door in opening direction 17. By a height adjustment of the two fittings 20, the door panel 2 can be accurately adjusted. With such an arrangement, the acceleration and deceleration arrangement 81 of the second fitting 20 may be used for controlling the movement of the sliding door 1 into its open end position.

The fitting 20 may be used in connection with light as well as with heavy sliding doors 1. As a result of its compact design, it can be easily installed in a pre-assembled state. The two longitudinal webs 62 surround the threaded sleeve 7 of the profile element 4 and are centered thereby so that a secure positioning of the fitting 20 on the door profile is ensured. The fitting 20 is compatible with existing door guide arrangements.

Also, a combination of the various exemplary embodiments is possible.

LISTING OF REFERENCE NUMERALS

| | |
|---|---|
| 1 | Sliding door |
| 2 | Door panel |
| 3 | Support frame |
| 4 | Profile element, horizontal |
| 5 | Profile opening |
| 6 | Profile web |
| 7 | Cylindrical rod, threaded sleeve |
| 8 | Internal thread |
| 9 | Accommodation openings |
| 11 | Profile element, vertical |
| 12 | Profile opening of (11) |
| 13 | Adjustment stop surface |
| 14 | Door panel |
| 15 | Longitudinal direction |
| 16 | Closing direction |
| 17 | Opening direction |
| 18 | Adjustment screw |
| 20 | Door fitting |
| 21 | Adjustment screw |
| 23 | First tension screw |
| 24 | Rest position |
| 31 | Housing |
| 32 | Right side plate |
| 33 | Left side plate |
| 34 | Spacer pin |
| 35 | Spacer pin |
| 36 | Interior space of (31) |
| 37 | Top end (23, 33) |
| 38 | Spring holder |
| 41 | Support roller |
| 42 | Guide rim |
| 43 | Inner ring |
| 45 | Brush receiving holder |
| 46 | Brush carrier |
| 47 | T-groove |
| 48 | Cleaning brush |

-continued

| | |
|---|---|
| 51 | Grooves |
| 52 | Insertion area |
| 53 | Guide area |
| 54 | Inclined path |
| 55 | Security path |
| 56 | Stop |
| 57 | Upper stop |
| 61 | Lift member |
| 62 | Longitudinal webs |
| 63 | Projections |
| 64 | Outer sides |
| 65 | Guide elements |
| 66 | Top side |
| 67 | Spring holder |
| 68 | Accommodation groove |
| 69 | Threaded insert |
| 81 | Acceleration and deceleration arrangement |
| 82 | Support part |
| 83 | Guide surface |
| 84 | Guide section |
| 85 | Holding section |
| 86 | Curved section |
| 87 | Guide groove |
| 88 | Widened area |
| 89 | Stop |
| 91 | Carrier element |
| 92 | Slide element |
| 93 | Guide and accommodation element |
| 94 | First guide surface |
| 95 | Second guide surface |
| 96 | Spring holder |
| 101 | Drag range |
| 102 | Stop pin, elastic deformable |
| 103 | Stop pin |
| 104 | Stop surfaces |
| 105 | Bottom surface |
| 106 | Carrier cavity |
| 111 | Cylinder piston unit |
| 112 | Cylinder |
| 113 | Closed end of (112) |
| 114 | Cylinder head cover |
| 115 | Piston rod |
| 116 | Piston rod head |
| 117 | Piston |
| 118 | Piston seal |
| 121 | Energy store |
| 131 | Cleaning brush |
| 132 | Brush carrier |
| 140 | Door track |
| 150 | Carrier member |
| 151 | Engagement projection |
| 152 | Engagement projection |
| 153 | groove |

What is claimed is:

1. A door fitting (20) with height adjustment for a sliding door (1) which is movable between a closed rest position (24) and an open end position, the door fitting comprising: a housing (31) including opposite side walls (32, 33) with at least one support roller (41) rolalably supported in the housing (31), a lifting member (61) adjustably disposed in the housing via at least four guide elements (65) engaged in inclined guide paths (54) formed in the opposite side wails (32, 33) of the housing (31), each of the inclined guide paths (54) having first and second end stops (56, 57) of which first end stop (56) defines a lower end position and the second stop determines an upper end position of the sliding door (1), each inclined guide path (54) having an entrance area (52) formed at the second end stop (57) of the inclined guide path (54), and a returned element (23) connected to the housing and to the lifting member (61) so as to bias the lifting member (61) with the guide elements (65) relative to the housing (31) in a direction toward the first end stop (56).

2. The door fitting according to claim 1, including an adjustment device (21, 69) with an adjustment element (21) for moving the lifting member (61) toward the second end stop (57) thereby raising the lifting member (61) and together herewith the sliding door (1) relative to the housing (31).

3. The door fitting according to claim 1, including an acceleration and deceleration arrangement (81).

4. The door fitting according to claim 1, wherein the lifting member (61) includes two longitudinal webs (62).

5. The door fitting according to claim 1, wherein the guide elements (65) have an oval cross-sectional area.

6. The door fitting according to claim 1, wherein the inclined guide paths (54) are arranged in the housing (31) and the guide elements (65) are arranged in the lifting member (61).

7. A sliding door (1) with at least one door fitting (20) according to claim 1.

8. The sliding door (1) according to claim 7, wherein the lifting member (61) has longitudinal webs (62) which extend around a threaded sleeve (7) of a support frame (3) of the sliding door (1).

9. The sliding door (1) according to claim 7, including a support frame (3) with an adjustment element abutment surface (13).

* * * * *